US005833129A

United States Patent [19]

Smith

[11] Patent Number: 5,833,129

[45] Date of Patent: Nov. 10, 1998

[54] PICTURE FRAME POST CARD

[76] Inventor: Jeanne M. Smith, 315 Branard #2, Houston, Tex. 77006

[21] Appl. No.: 803,971

[22] Filed: Feb. 21, 1997

Related U.S. Application Data

[60] Provisional application No. 60/012,370, Feb. 27, 1996.

[51] Int. Cl.[6] ..... B42D 15/00

[52] U.S. Cl. ..... 229/92.8; 229/71

[58] Field of Search ..... 229/92.8, 71

[56] References Cited

U.S. PATENT DOCUMENTS

| | | | |
|---|---|---|---|
| 922,035 | 5/1909 | Pifer . | |
| 1,347,269 | 7/1920 | Greble | 229/92.8 X |
| 2,219,492 | 10/1940 | Prichap . | |
| 2,810,974 | 10/1957 | Nichols . | |
| 2,828,565 | 4/1958 | Goldstein | 229/92.8 X |
| 2,832,176 | 4/1958 | Vergeer . | |
| 3,001,690 | 9/1961 | Paterson | 229/92.8 X |
| 3,083,488 | 4/1963 | Goldstein . | |
| 3,123,207 | 3/1964 | Goldstein . | |
| 3,174,244 | 3/1965 | Walton . | |
| 3,545,115 | 12/1970 | Nichols . | |
| 3,763,583 | 10/1973 | Gregg . | |
| 3,995,388 | 12/1976 | Penick et al. . | |
| 4,024,656 | 5/1977 | Farnsworth . | |
| 4,084,015 | 4/1978 | Patterson . | |
| 4,167,241 | 9/1979 | Zumbrunn . | |
| 4,237,633 | 12/1980 | Murrell . | |
| 4,343,105 | 8/1982 | Isaacson . | |
| 4,428,526 | 1/1984 | Riley . | |
| 4,450,638 | 5/1984 | Bader . | |
| 4,531,316 | 7/1985 | Farnum . | |
| 4,559,727 | 12/1985 | Lewyt . | |
| 4,640,030 | 2/1987 | Wood et al. . | |
| 4,662,093 | 5/1987 | Suttles et al. . | |
| 4,681,253 | 7/1987 | Engelhardt . | |
| 4,780,975 | 11/1988 | Friedman . | |
| 4,825,574 | 5/1989 | George . | |
| 4,947,566 | 8/1990 | Hoebel . | |
| 4,953,780 | 9/1990 | Ross . | |
| 5,337,949 | 8/1994 | Seeley . | |
| 5,678,756 | 10/1997 | Sugiura | 229/92.8 X |

FOREIGN PATENT DOCUMENTS

WO89/06192 7/1989 WIPO .

*Primary Examiner*—Jes F. Pascua

*Attorney, Agent, or Firm*—Arnold, White & Durkee; Bill Durkee

[57] ABSTRACT

A picture frame postcard for transmitting and displaying a photograph or other visual display. The picture frame postcard includes a housing having a front face and a rear face and defining an interior region for containing a photograph or other visual display. The front face includes a removable panel to permit the display of the photograph or other visual display contained within. The rear face may used to provide a postage and address panel and includes a slot into which the removable panel may be placed to permit the entire assembly to be supported in the vertical direction to facilitate viewing of the photograph or other visual display.

17 Claims, 8 Drawing Sheets

PICTURE FRAME POST CARD

CROSS REFERENCE TO RELATED APPLICATIONS

This application is a continuation of provisional patent application Ser. No. 60/012,370 filed on Feb. 27, 1996.

BACKGROUND OF THE INVENTION

1. Field of the Invention

The present invention relates generally to display devices for photographs and, more particularly, to picture frames adapted for easy transport.

2. Background of the Invention

Postcards are commonly used for communicating with friends and loved ones and are both economical and easy to use.

SUMMARY OF THE INVENTION

In accordance with one aspect of the present invention, a picture frame postcard adapted for transport using conventionally available mail service is provided that includes a housing defining an interior space adapted to contain a photograph or other visual display device. The housing further includes a removable panel on a front face of the housing that permits the recipient of the picture frame postcard to view the photograph contained within the housing.

BRIEF DESCRIPTION OF THE DRAWINGS

The present invention will become more fully understood from the following detailed description of the preferred embodiments, taken in conjunction with the accompanying drawings in which.

DESCRIPTION OF ILLUSTRATIVE EMBODIMENTS

Figure 1A:
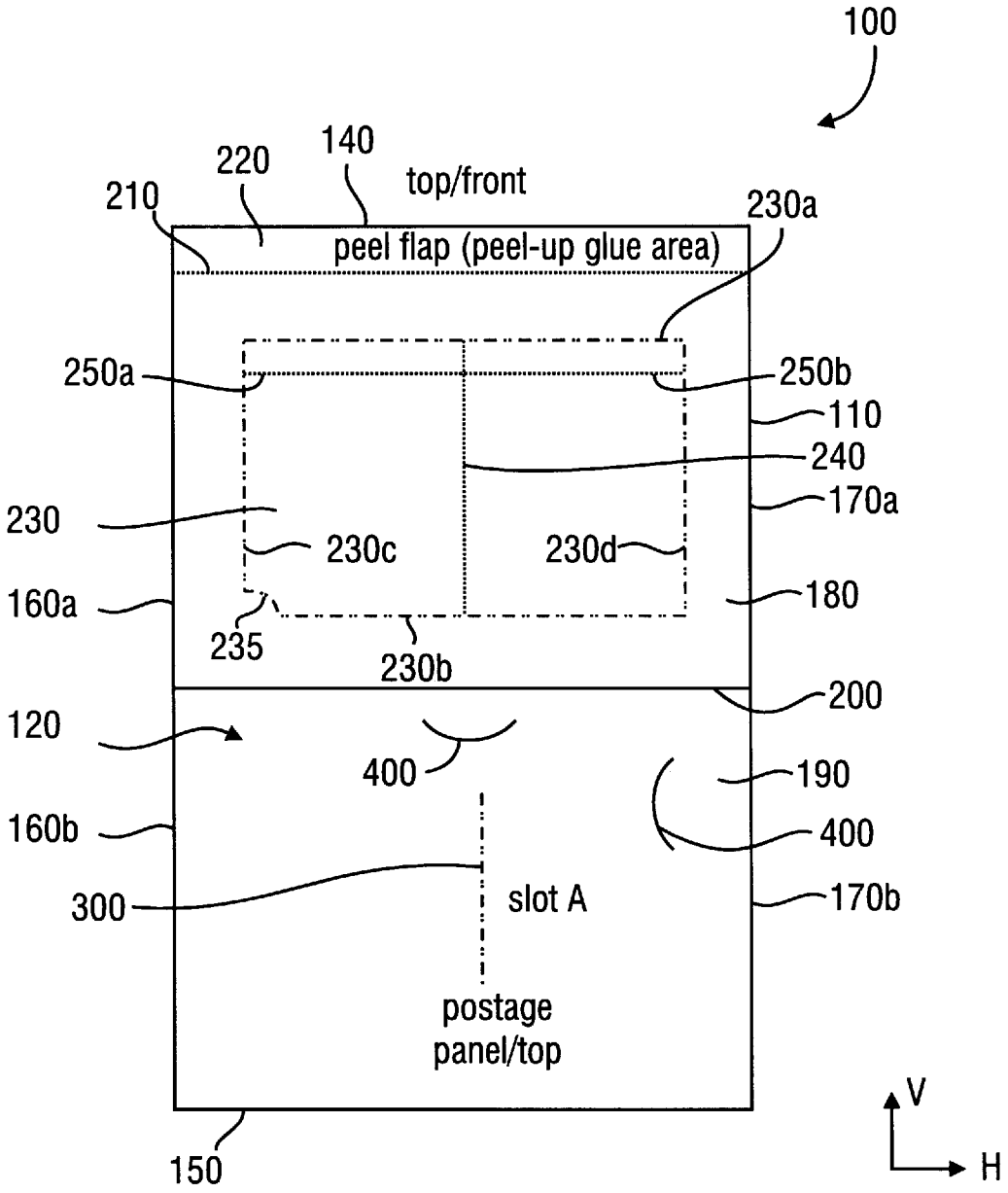
FIG. 1*a* is a front view of a preferred embodiment of a picture frame postcard prior to assembly in a substantially flattened condition.
Figure 1B:
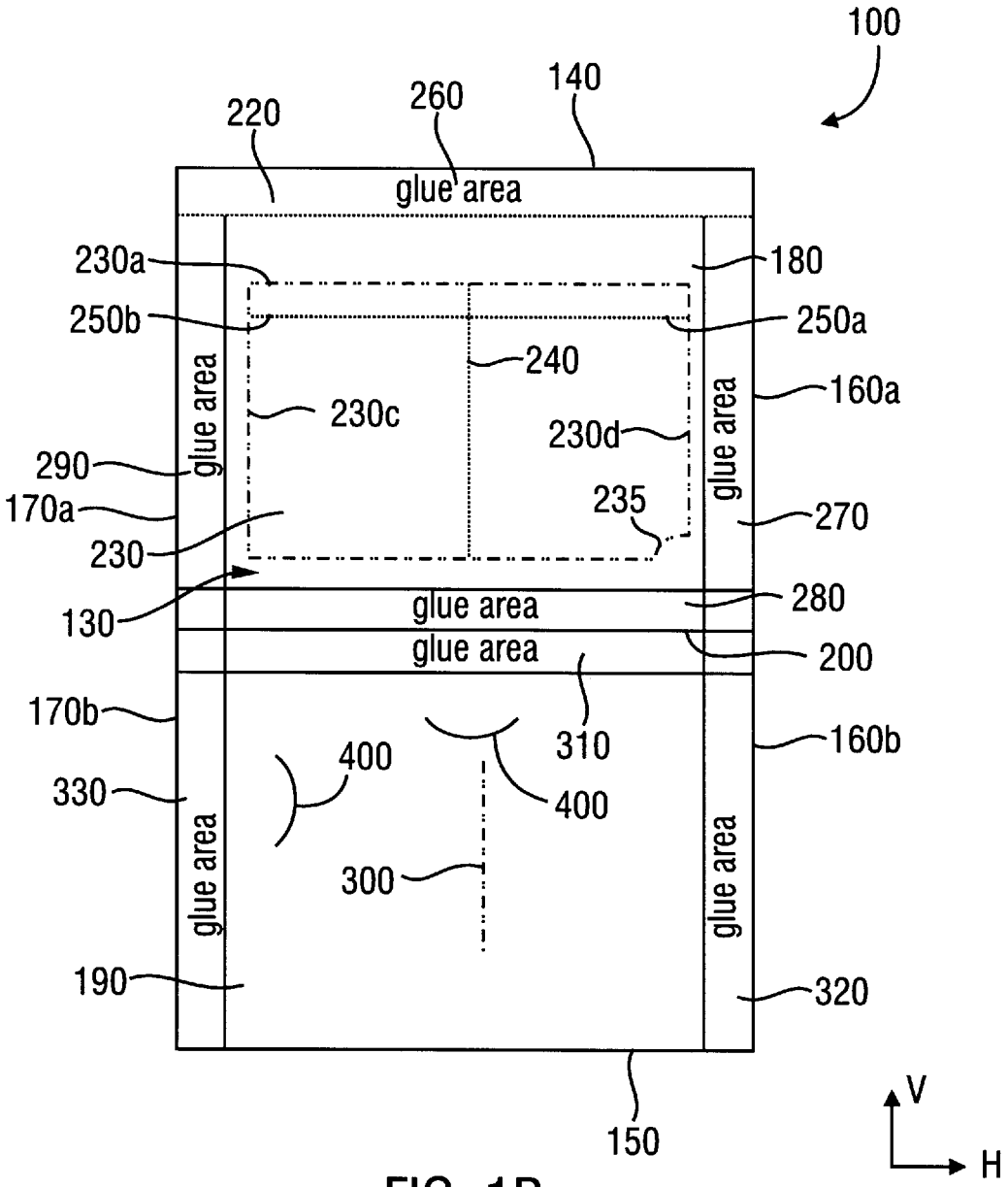
FIG. 1*b* is a rear view of the picture frame postcard of FIG. 1*a* in a substantially flattened condition prior to assembly.

The illustrative embodiments described herein provide a picture frame postcard permitting an individual to mail a picture to a friend or loved one that can be displayed by the receiving party using only the picture frame postcard. While illustrated by means of specific illustrative embodiments providing a picture frame postcard, the illustrative embodiments will also find broad application to a wide-range of applications calling for the transmission of visual information using a conventional mail or parcel delivery service. Therefore, the illustration by means of a picture frame postcard is meant to be illustrative and not limiting.

Referring to FIGS. 1*a*, 1*b*, 2, 3, 4 and 5, a preferred embodiment of a picture frame postcard 100 will now be described. The picture frame postcard 100 is constructed from a main panel 110 having a front face 120, a rear face 130, upper and lower edges 140 and 150, upper left and right edges 160*a* and 170*a*, and lower left and right edges 160*b* and 170*b*. The main panel 110 further includes an upper region 180 and a lower region 190 defined by a scored dividing line 200. In a preferred embodiment, the lower region 190 is used to provide postage and address information for mailing the picture frame postcard 100.

The main panel 110 may be approximately rectangular in shape and may have overall dimensions of approximately 7"×9½" with a thickness of about 1/32". In a preferred embodiment, the main panel is substantially rectangular in shape and has overall dimensions of about 7"×9½" with a thickness of about 1/32". The upper region 180 of the main panel 110 may be approximately rectangular in shape and may have overall dimensions of approximately 7"×5 1/16". The lower region 190 of the main panel 110 may be approximately rectangular in shape and may have overall dimensions of approximately 7"×4½". In a particularly preferred embodiment, the left and right upper edges 160*a* and 170*a* are longer than the left and right lower edges 160*b* and 170*b*. In this manner the upper region 180 will overlap the lower region 190 thereby providing a sealing flap that may be provided with an adhesive surface for sealing the interior of the picture frame postcard 100. The overall dimensions of the picture frame postcard 100 may be adjusted to accomodate a range of photograph sizes. The main panel 110 may be constructed from any number of conventional lightweight materials. In a preferred embodiment, the main panel 110 is constructed from paper postcard stock.

The scored dividing line 200 may be positioned approximately parallel to the upper edge 140 and the lower edge 150. In a preferred embodiment, the scored dividing line 200 is substantially parallel to the upper edge 140 and the lower edge 150. The scored dividing line 200 may be provided using conventional scoring methods.

The upper region 180 of the main panel 110 includes an upper scored line 210 defining a flap 220, a removable perforated panel 230 having upper, lower, left and right outer edges 230*a*, 230*b*, 230*c*, and 230*d*, a first scored line 240, a second scored line 250*a* and a third scored line 250*b*, and first, second, third, and fourth glue areas 260, 270, 280 and 290.

The upper scored line 210 may be aligned approximately parallel to the upper edge 140 and may be positioned approximately ⅜" to ½" from the upper edge 140. In a preferred embodiment, the upper scored line 210 is aligned substantially parallel to the upper edge 140 and is positioned about ⅝" to ½" from the upper edge 140. The upper scored line 210 may be provided using conventional scoring methods.

The flap 220 may be provided with a glue area 260 having an adhesive surface covered with peelable tape. The adhesive surface and peelable tape of the preferred embodiment may be applied using conventional methods and materials. In this manner, the user of the picture frame postcard 100 may easily remove the peelable tape and fold over the flap 220 to seal the interior of the picture frame postcard 100. In an alternative embodiment, the glue area 260 may be provided with a dry adhesive that must be applied with moisture by the user in order to seal the flap 220. In still another alternative embodiment, the user may simply apply an adhesive or other sealing device such as, for example, tape or staples to seal the picture frame postcard 100.

The removable perforated panel 230 may be approximately rectangular and may have overall dimensions of approximately 4½"×3". In one preferred embodiment, removable perforated panel 230 is substantially rectangular and has overall dimensions of about 4½"×3". In an alternative preferred embodiment, the removable perforated panel is substantially square. The perforations of the removable perforated panel 230 may be produced using conventional methods.

The first scored line 240 may aligned approximately parallel to the left and right edges 230*c* and 230*d* and may be positioned approximately halfway between the left and right edges 230*c* and 230*d*. In a preferred embodiment, the first scored line 240 is aligned substantially parallel to the left and right edges 230*c* and 230*d* and is positioned substantially halfway between the left and right edges 230*c* and 230*d*. The first scored line 240 may be provided using conventional scoring methods.

The second and third scored lines 250*a* and 250*b* may aligned approximately parallel to the upper and lower edges 230*a* and 230*b* and may be positioned approximately ¾" to 1" from the upper edge 230*a*. In a preferred embodiment, the second and third first scored lines 250*a* and 250*b* are aligned substantially parallel to the upper and lower edges 230*a* and 230*b* and are positioned about 1" from the upper edge 230*a*. The second and third scored lines 250*a* and 250*b* may be provided using conventional scoring methods.

In a particularly preferred embodiment, the removable perforated panel 230 further includes a slotted perforated edge 235 to facilitate the removal of the removable perforated panel. The slotted perforated edge 235 may be provided using conventional methods of slotting.

The second, third, and fourth glue areas 270, 280 and 290 are provided adjacent to the upper left edge 160*a*, the scored dividing line 200 and the upper right edge 170*a* respectively. In a preferred embodiment, a thin layer of a conventional adhesive is applied to each of these glue areas, 270, 280 and 290, to permit assembly of the picture frame postcard by folding the upper and lower regions 180 and 190 about the scored dividing line 200. This will bring the upper and lower regions 180 and 190 into intimate contact thereby bonding the upper and lower regions 180 and 190 together. This can also be used to hold the photograph or other visual display in place by means of the adhesive placed on the glue areas, 270, 280 and 290. In an alternative embodiment, other types of bonding agents such as, for example, tape or staples may be used.

The lower region 190 of the main panel 110 includes a perforated slot 300, and fifth, sixth and seventh glue areas 310, 320, and 330.

The perforated slot 300 may positioned approximately halfway between and parallel to the lower left and right edges 160*b* and 170*b*. In a preferred embodiment, the perforated slot 300 is positioned about halfway between and substantially parallel to the lower left and right edges 160*b* and 170*b*. The perforated slot 300 may range from approximately 1¾" to 1 13/16" in length. In a preferred embodiment, the perforated slot is about 1 13/16" in length. The perforated slot 300 may be positioned approximately perpendicular to and halfway between the scored dividing line 200 and the lower edge 150. In a preferred embodiment, the perforated slot 300 is positioned substantially perpendicular to and halfway between the scored dividing line 200 and the lower edge 150. The perforated slot 300 may be provided using conventional slotting methods.

The fifth, sixth and seventh glue areas 310, 320, and 330 are provided adjacent to the scored dividing line 200, the lower left edge 160*b* and the lower right edge 170*b* respectively. In a preferred embodiment, a thin layer of a conventional adhesive is applied to each of these glue areas to permit assembly of the picture frame postcard by folding the upper and lower regions 180 and 190 about the scored dividing line 200 into intimate contact. In an alternative embodiment, other types of bonding agents such as, for example, tape or staples may be used.

Figure 2:
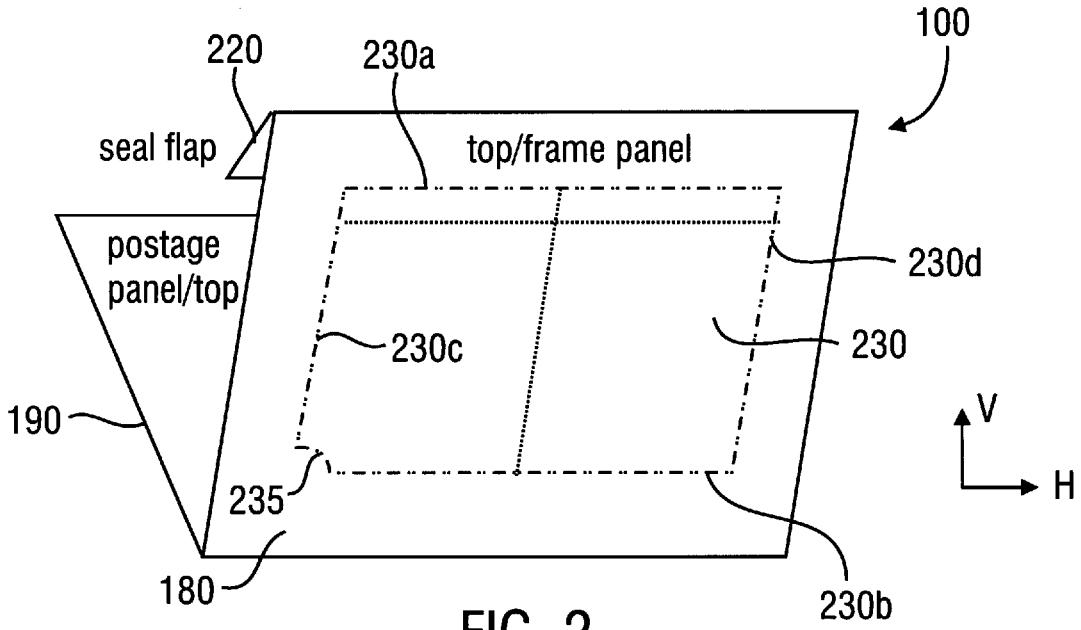
FIG. 2 is a perspective view of the assembly of the picture frame postcard of FIG. 1*a* by folding the unassembled picture frame postcard about a predetermined line.
Figure 3:
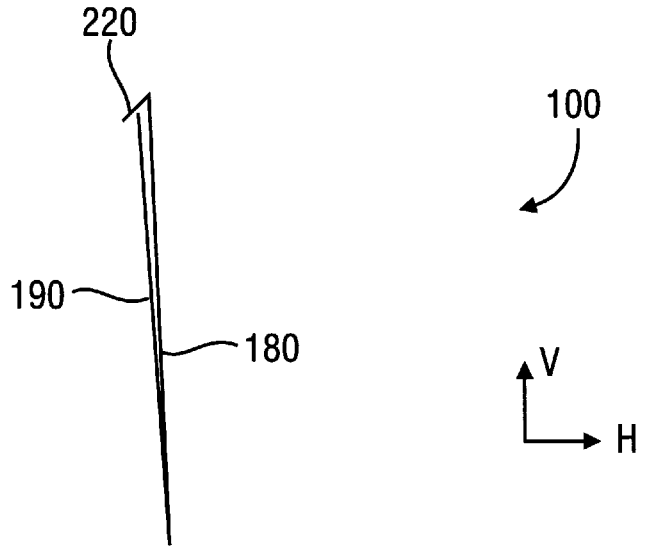
FIG. 3 is a side view of the assembly of the picture frame postcard of FIG. 1*a* by folding the unassembled picture frame postcard about a predetermined line.
Figure 4:
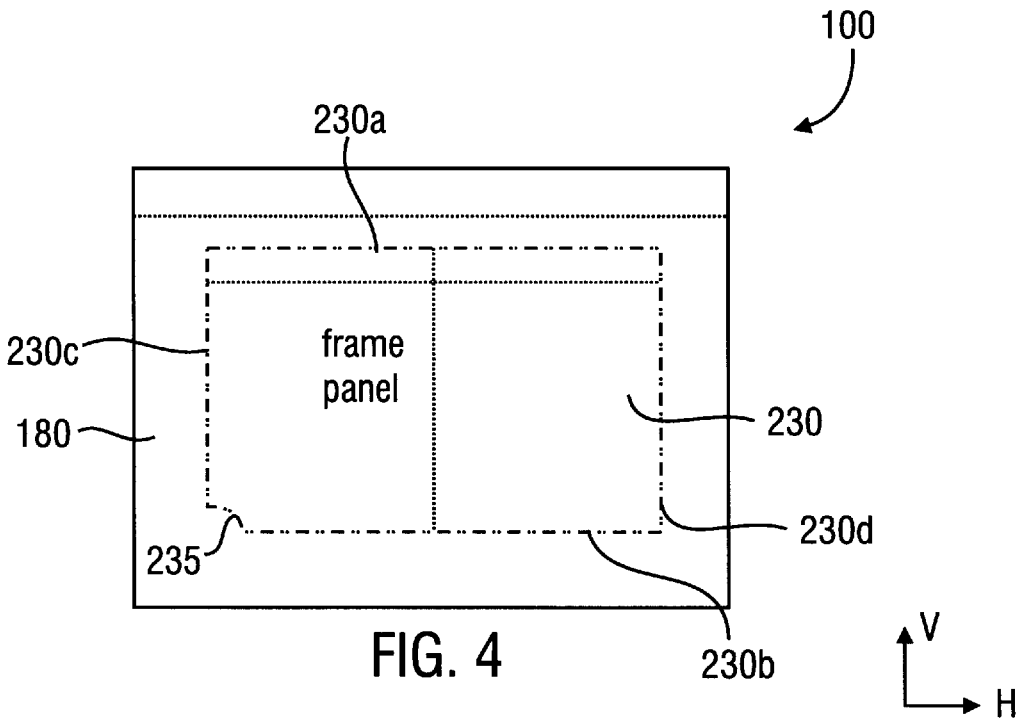
FIG. 4 is a front view of the picture frame postcard of FIG. 1*a* in an assembled condition.
Figure 5:
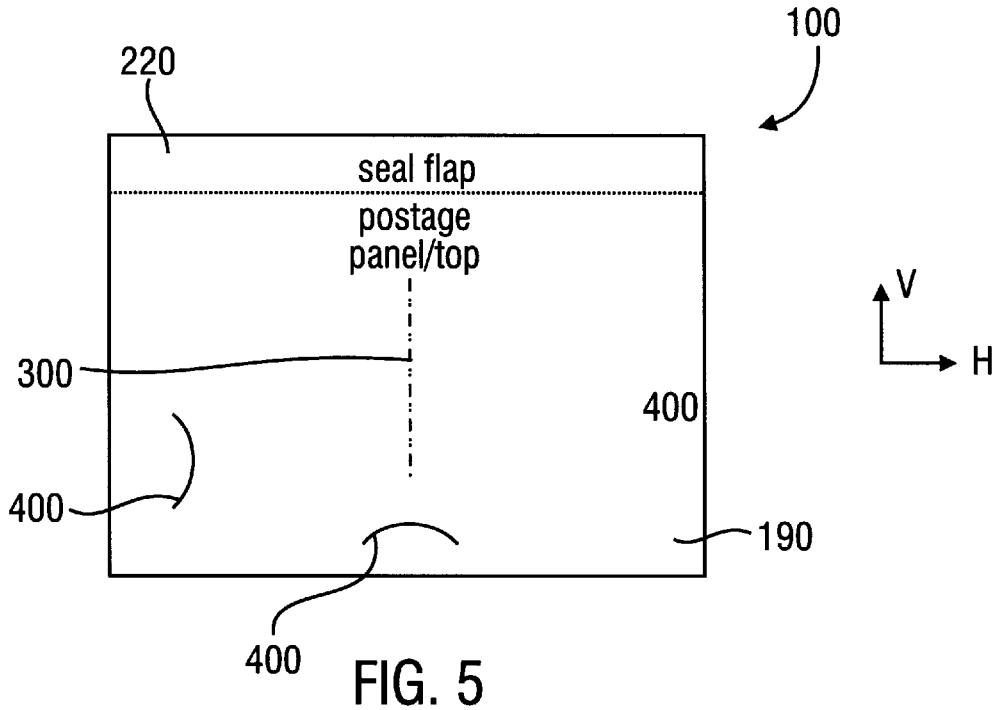
FIG. 5 is a rear view of the picture frame postcard of FIG. 1*a* in an assembled condition.

As illustrated in FIGS. 2 and 3, the picture frame postcard 100 is assembled by folding the upper and lower regions 180 and 190 about the scored dividing line 200 and placing the upper and lower regions 180 and 190 into intimate contact. The adhesive agents applied to the glue areas 270, 280, 290, 310, 320 and 330 will then bond the upper and lower regions 180 and 190 together to form the completed assembly illustrated in FIGS. 4 and 5. The interior region of the completed picture frame postcard 100 may then be used to hold a photograph or other visual display device. The interior region of the picture frame postcard 100 may then be sealed by folding over the sealing flap 220.

In an alternative embodiment, one or more semi-circular slots 400 may be provided in addition to or in lieu of one or more of the glue areas, 270, 280, 290, 310, 320 and 330 to hold the photograph or other visual display in place within the picture frame postcard 100. Furthermore, one or more of the glue areas 270, 280, 290, 210, 320 and 330 may be omitted since the flap 220 will hold the assembled picture frame postcard together.

Figure 6:
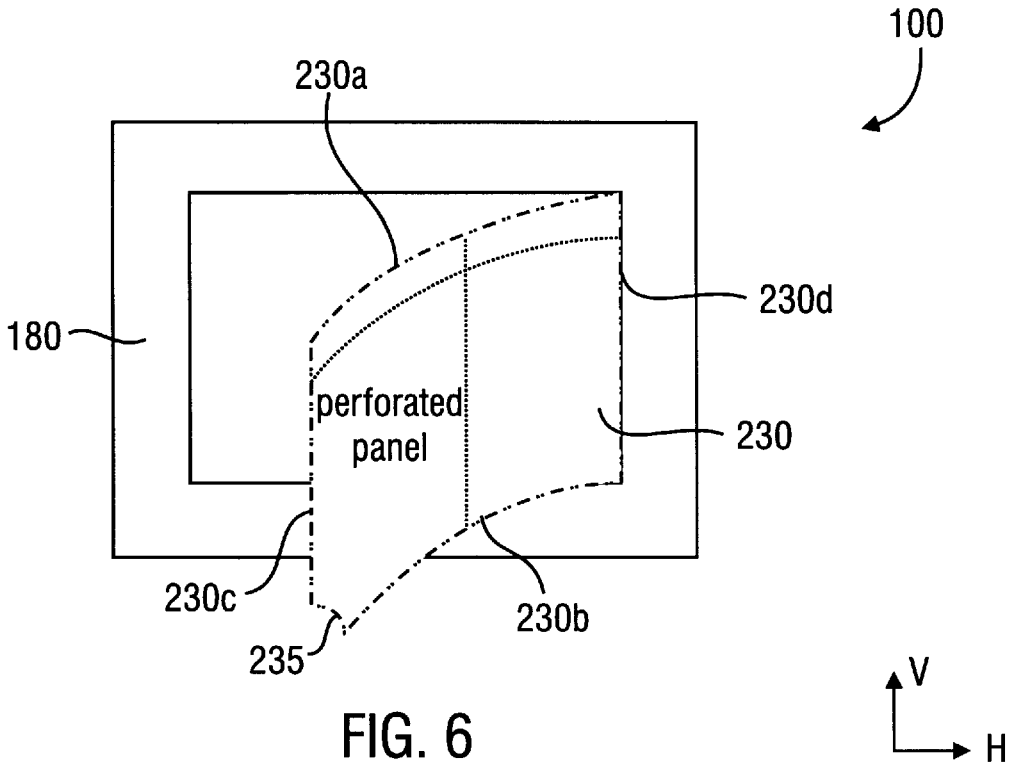
FIG. 6 is a front view of the assembled picture frame postcard of FIG. 4 illustrating the removal of the perforated panel.
Figure 7:
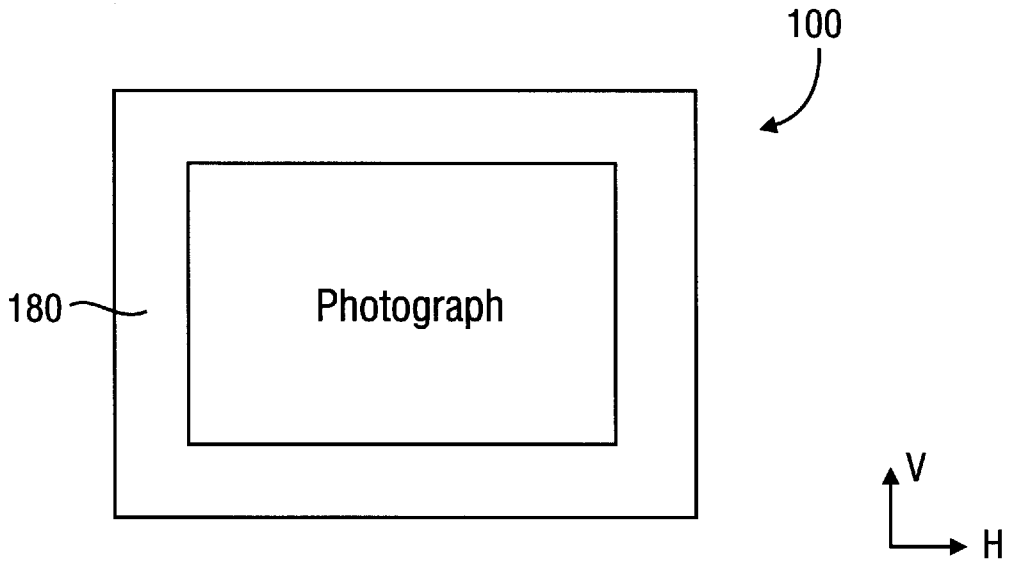
FIG. 7 is a front view of the picture frame postcard of FIG. 6 with the perforated front panel removed.
Figure 8:
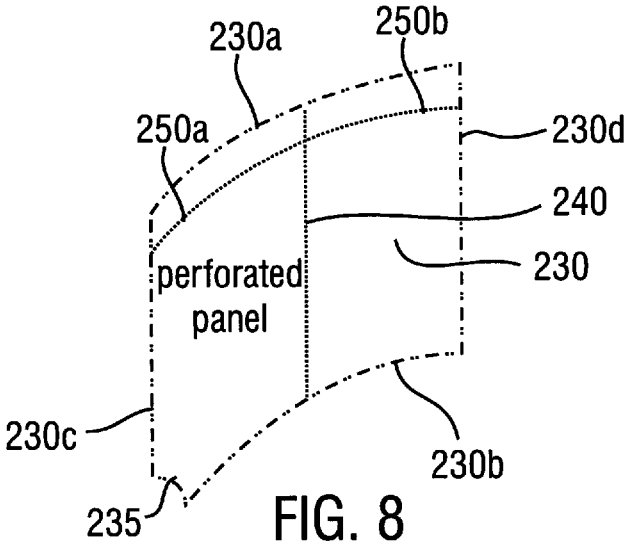
FIG. 8 is an illustration of a preferred embodiment of the perforated panel.
Figure 9:
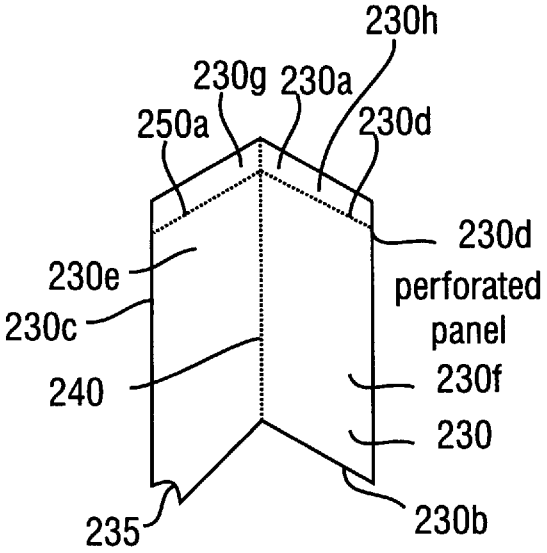
FIG. 9 is an illustration of the perforated panel of FIG. 8 demonstrating folding the perforated panel about a predetermined line.
Figure 10:
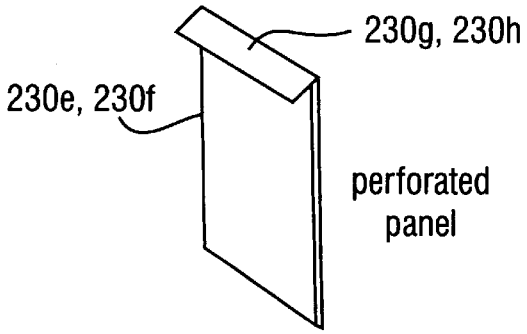
FIG. 10 is an illustration of the perforated panel of FIG. 8 demonstrating folding the perforated panel about another predetermined line.
Figure 11A:
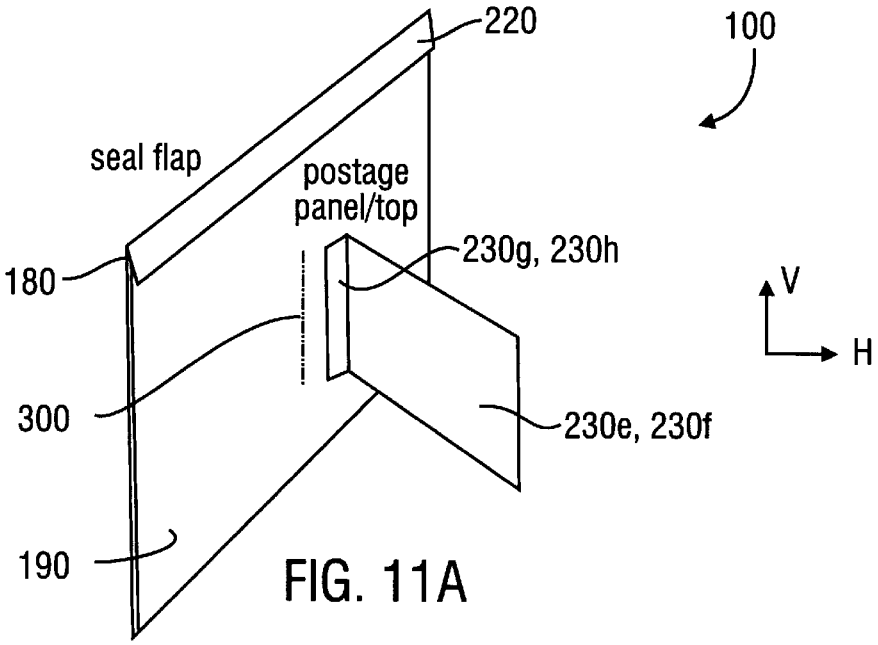
FIG. 11*a* is a rear perspective view of the use of the folded perforated panel to support the picture frame postcard.
Figure 11B:
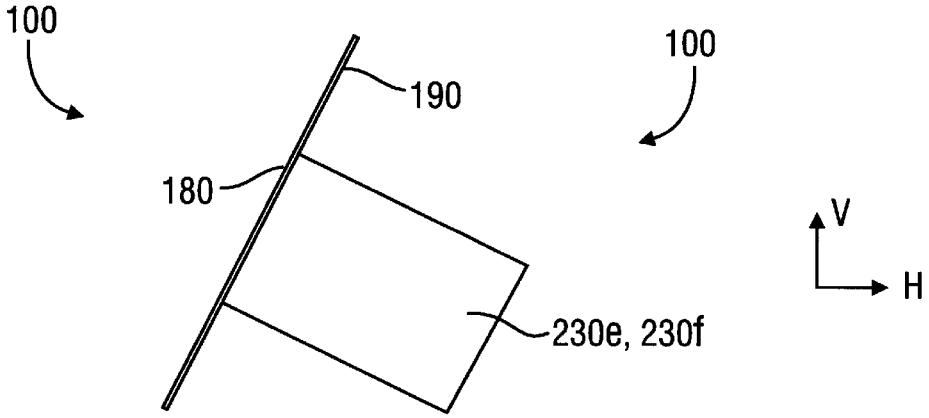
FIG. 11*b* is a side view of the use of the folded perforated panel to support the picture frame postcard.
Figure 12A:
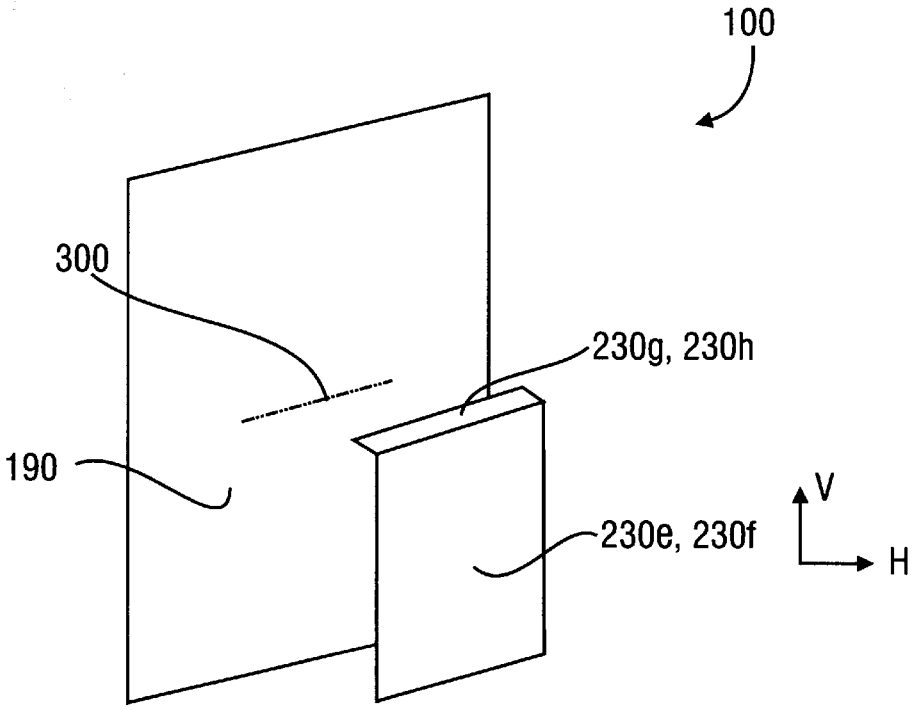
FIG. 12*a* is a rear perspective view of another use of the folded perforated panel to support the picture frame postcard.
Figure 12B:
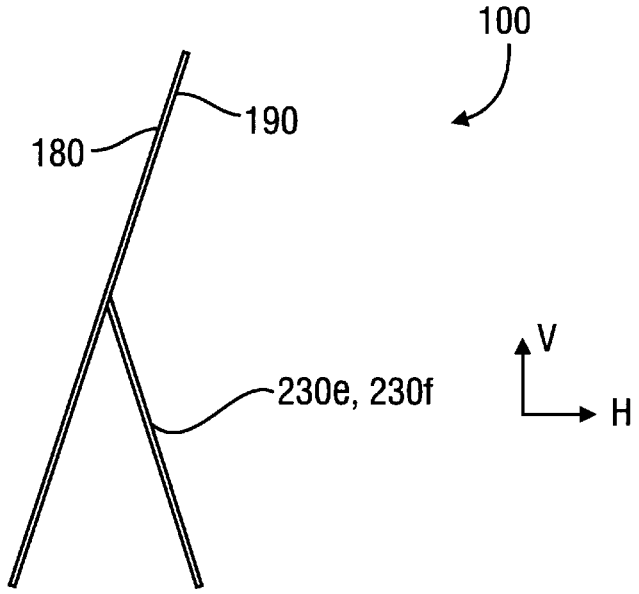
FIG. 12*b* is a side view of another use of the folded perforated panel to support the picture frame postcard.

The picture frame postcard 100 may then be sent to a friend or loved one using conventional mail or parcel delivery services. As illustrated in FIGS. 6 and 7, the recipient of the delivered picture frame postcard 100 may then display the photograph or other visual display by removing the perforated panel 230. Note that the photograph or other visual display device may be oriented vertically or horizontally as indicated by the arrows V and H.

Referring now to drawing FIGS. 8, 9, 10, 11*a*, 11*b*, 12*a* and 12*b*, the use of the perforated panel 230 to facilitate the display of the photograph or other visual display device contained within the picture frame postcard 100 will be described. The removable perforated panel 230 having been removed from the picture frame postcard may be divided into sub-panels identified as first portion 230*e* and second portion 230*f* each having first and second flaps 230*g* and 230*h* defined by the scored lines 250*a* and 250*b*. As illustrated in FIGS. 11*a*, 11*b*, 12*a* and 12*b*, the first or second portions 230*e* or 230*f* may then be used to support the picture frame postcard 100 in either of two orientations by inserting the first or second flaps 230*g* or 230*h* into the slot 300. In an alternative embodiment, additional sub-panels may be provided by adding additional scoring lines oriented similar to scoring line 240. In yet another alternative embodiment, no sub-panels may be provided at all.

A picture frame postcard has been described that permits an individual to send a photograph or other visual display device to a friend or loved one using conventional mail or parcel services. The recipient of the picture frame postcard may then easily display the photograph contained within by removing a removable panel and then support the photograph contained within by supporting the picture frame postcard using the removable panel. Alternatively, the recipient of the of picture frame postcard may display the photograph contained within a conventional picture frame with the picture frame postcard providing a matte for the photograph contained within.

While the apparatus has been described with reference to specific illustrative embodiments of a picture frame postcard, the teachings of the present illustrative embodiments will find wide application to any number of applications requiring the transmission of visual information using conventional mail or parcel delivery services.

What is claimed is:

1. A picture frame postcard for mailing enclosed visual material and then framing and displaying the visual material after transmittal, which postcard comprises:

a) a postcard having a front panel and rear panel with an interior space between them for accepting visual material inside, b) at least one separable score in the front panel to form a removable area in the front panel which can be removed to expose visual material and cause the remaining portion of the front panel to form a frame around exposed visual material, c) a slot in the rear panel, and d) the removable area in the front panel after removal being bendable along a line to form a portion insertable in the slot in the rear panel for holding the remaining portion of the removable area as an extension from the rear panel to support the framed visual material in the postcard in a display position.

2. The postcard of claim 1 in which the slot in the rear panel is a scored line for separation to allow insertion of a portion of the removable area.

3. The postcard of claim 1 in which a folded sheet forms the front panel and the rear panel along a fold across the sheet, the outer edges of the front and rear panels which extend from the fold are attached together to form interior space for acceptance of visual material, and the remaining opening between the front and rear panels being sealable after visual material is inserted.

4. The postcard of claim 3 in which a flap extends from one of the front and rear panels and folds over the remaining opening to seal against the other panel.

5. The postcard of claim 1 in which the removable area of the front panel is a size for the remaining portion of the front panel to frame a photograph.

6. The postcard of claim 1 in which the removable area contains a scored line which enables an end of the removable area to be bent for insertion in the slot and for holding the remaining length of the removable area as an extension from the rear panel to support the framed visual material in a display position.

7. The postcard of claim 1 in which the periphery of the removable area follows at least one score in the front panel to allow removal of the area, and the removable area includes a first foldable score across it near an end and a second foldable score transverse of the first foldable score whereby the removable area is foldable along the second score and then foldable along the first score to form a folded support for insertion in the slot, the fold along the first score being insertable in the slot to hold the remaining length as a rearward extension from the rear panel to provide a support.

8. The postcard of claim 1 in which the periphery of the removable area is perforated to allow removal of the area from the front panel.

9. The postcard of claim 8 in which the periphery of the removable area is sized to frame a photograph.

10. The postcard of claim 1 in which the slot in the rear panel is transverse of the length of the rear panel and located about midway of the length of the rear panel.

11. The postcard of claim 10 in which the slot in the rear panel is slightly longer than the width of the removable area when it is folded in half.

12. The postcard of claim 1 in which tabs are located in the rear panel for positioning into the interior space to form supports for positioning visual material within the frame.

13. A picture frame postcard for mailing an enclosed photograph and then framing and displaying the photograph, which postcard comprises:

a) a single sheet of material with a fold to form a front panel and rear panel with the outer edges of the front and rear panels extending from the fold being attached to form an interior space between the panels for accepting a photograph inside through the remaining opening away from the fold, and a flap extending from one of the panels to close the remaining opening and seal against the other panel after insertion of a photograph, b) a rectangular perforation in the front panel to form a removable area which can be removed to expose the enclosed photograph and cause the remaining portion of the front panel outside the perforation to form a frame around the photograph, c) a slot in the rear panel transverse and located about midway of the length of the rear panel, and d) the removable area containing a scored line which enables an end of the removable area to be bent transversely across its length after removal for insertion in the slot and for holding the remaining length of the removable area as an extension from the rear panel to support the photograph in a display position.

14. The postcard of claim 13 in which the removable area includes a first foldable score across its width near an end and another foldable score along the middle of its length whereby the removable area is foldable along its length and then foldable along the first score to form a folded support for insertion in the slot, the fold along the first score being insertable in the slot to hold the remaining length as a rearward extension from the rear panel to provide a support for display of the photograph.

15. The postcard of claim 14 in which tabs are located in the rear panel for positioning into the interior space to form supports for positioning a photograph within the frame.

16. The postcard of claim 14 in which the flap extends from the front panel, and addressing information is on the rear panel to the right of the slot as viewed from the fold, and space for a message is on the rear panel to the left of the slot.

17. The postcard of claim 14 in which tabs are located in the rear panel for positioning into the interior space to form supports for positioning a photograph within the frame, the flap extends from the front panel, addressing information is on the rear panel to the right of the slot as viewed from the fold, and space for a message is on the rear panel to the left of the slot.

* * * * *